US009880478B2

(12) United States Patent
Shimano et al.

(10) Patent No.: US 9,880,478 B2
(45) Date of Patent: Jan. 30, 2018

(54) METHOD OF PRODUCING TONER

(71) Applicant: CANON KABUSHIKI KAISHA, Tokyo (JP)

(72) Inventors: Tsutomu Shimano, Mishima (JP); Kunihiko Nakamura, Gotemba (JP); Kenta Kamikura, Yokohama (JP); Yuichi Yajima, Susono (JP); Kenji Ookubo, Numazu (JP); Dai Nozaki, Numazu (JP); Tohru Hiramatsu, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/393,455

(22) Filed: Dec. 29, 2016

(65) Prior Publication Data

US 2017/0199474 A1 Jul. 13, 2017

(30) Foreign Application Priority Data

Jan. 8, 2016 (JP) ..... 2016-002544

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/097*** | (2006.01) |

(52) U.S. Cl.

CPC ..... *G03G 9/0812* (2013.01); *G03G 9/0806* (2013.01); *G03G 9/0819* (2013.01); *G03G 9/08711* (2013.01); *G03G 9/08755* (2013.01); *G03G 9/0918* (2013.01); *G03G 9/09708* (2013.01)

(58) Field of Classification Search

CPC . G03G 9/0812; G03G 9/0806; G03G 9/09708
USPC ..... 430/137.15
See application file for complete search history.

(56) References Cited

U.S. PATENT DOCUMENTS

| | | | |
|---|---|---|---|
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 7,943,281 | B2 | 5/2011 | Kaya et al. |

(Continued)

FOREIGN PATENT DOCUMENTS

| | | |
|---|---|---|
| JP | 2000-081727 | 3/2000 |
| JP | 2006-082985 | 3/2006 |

(Continued)

*Primary Examiner* — Mark A Chapman
(74) *Attorney, Agent, or Firm* — Fitzpatrick Cella Harper and Scinto

(57) ABSTRACT

Provided is a method of producing a toner including a toner particle, the method including: a granulation step of mixing a polymerizable monomer composition containing a polymerizable monomer and an aqueous medium to form a suspension of particles of the polymerizable monomer composition; and a polymerization step of polymerizing the polymerizable monomer in each of the particles of the polymerizable monomer composition in the presence of a metal phosphate containing aluminum as a metal element to provide the toner particle, the content ratio of aluminum in the metal phosphate containing aluminum being 1.0 mol % or more and 95.0 mol % or less with respect to all metal elements, the metal phosphate containing aluminum being obtained by adding an aluminum compound to the aqueous medium and/or the suspension.

8 Claims, 2 Drawing Sheets

(56) References Cited

U.S. PATENT DOCUMENTS

| | | | |
|---|---|---|---|
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,158,216 | B2 | 10/2015 | Shimano et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,377,705 | B2 | 6/2016 | Shimano et al. |
| 9,383,668 | B2 | 7/2016 | Noji et al. |
| 9,423,708 | B2 | 8/2016 | Tominaga et al. |
| 9,500,972 | B2 | 11/2016 | Tanaka et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2015/0153666 | A1 | 6/2015 | Isono et al. |
| 2015/0153669 | A1 | 6/2015 | Yoshida et al. |
| 2015/0248071 | A1 | 9/2015 | Katsura et al. |
| 2015/0261110 | A1 | 9/2015 | Nakagawa et al. |
| 2015/0286157 | A1 | 10/2015 | Masumoto et al. |
| 2015/0370189 | A1 | 12/2015 | Tanaka et al. |
| 2016/0246195 | A1 | 8/2016 | Shimano et al. |
| 2016/0349640 | A1 | 12/2016 | Tanaka et al. |
| 2017/0052465 | A1 | 2/2017 | Shimano et al. |

FOREIGN PATENT DOCUMENTS

| | | |
|---|---|---|
| JP | 2007-322687 | 12/2007 |
| JP | 2008-009092 | 1/2008 |

METHOD OF PRODUCING TONER

BACKGROUND OF THE INVENTION

Field of the Invention

The present invention relates to a method of producing a toner to be used for developing an electrostatic latent image formed by a method, such as an electrophotographic method, an electrostatic recording method, or a toner jet recording method, for forming a toner image.

Description of the Related Art

In recent years, an improvement in image quality of a printer or a copying machine, and an increase in speed thereof have been required. A spherical toner excellent in chargeability and flowability is preferred for corresponding to any such high functionality. In order that the spherical toner may be stably produced, a suspension polymerization method has been investigated.

In order that the spherical toner may be obtained more efficiently and more stably in a toner production method based on the suspension polymerization method, various investigations have been made on a dispersion stabilizer at the time of suspension.

In Japanese Patent Application Laid-Open No. 2000-81727, there is a proposal of a toner production method based on the suspension polymerization method involving using a calcium phosphate compound as a dispersion stabilizer.

In Japanese Patent Application Laid-Open No. 2008-009092, there is a proposal of a toner production method based on the suspension polymerization method involving using magnesium hydroxide as a dispersion stabilizer and adding a water-soluble inorganic aluminum compound.

In Japanese Patent Application Laid-Open No. 2007-322687, there is a proposal of a toner production method based on the suspension polymerization method involving using hardly water-soluble inorganic aluminum as a dispersion stabilizer.

SUMMARY OF THE INVENTION

In each of the toner production methods disclosed in Japanese Patent Application Laid-Open No. 2000-81727 and Japanese Patent Application Laid-Open No. 2008-009092, the dispersion stabilizer may dissolve in a low-pH region, specifically a pH region of 5.0 or less. Accordingly, when a pH is reduced in a toner production process, toner particles coalesce to become a coarse particle. The occurrence of the coalescence of the toner particles involves a problem in that a toner yield reduces or the developability of a toner reduces.

In addition, in the toner production method disclosed in Japanese Patent Application Laid-Open No. 2007-322687, the solubility of the dispersion stabilizer is low. Accordingly, the dispersion stabilizer cannot be completely washed off in the step of washing a toner in some cases, and hence the dispersion stabilizer is liable to remain in the toner. When the dispersion stabilizer remains in the toner, the chargeability of the toner, especially chargeability under a high-humidity environment may be affected.

The present invention is directed to providing a method of producing toner particles that has solved the conventional problems. That is, the present invention is directed to providing a method of producing a toner in which the coalescence of toner particles in a production process is suppressed and a dispersion stabilizer can be easily removed in a washing step.

In order to achieve the above-mentioned object, according to one aspect of the present invention, there is provided a method of producing a toner including a toner particle, the method comprising:

a granulation step of mixing a polymerizable monomer composition containing a polymerizable monomer and an aqueous medium to form a suspension of particle of the polymerizable monomer composition; and a polymerization step of polymerizing the polymerizable monomer in the particle of the polymerizable monomer composition in a presence of a metal phosphate containing aluminum as a metal element to provide the toner particle, wherein, a content ratio of aluminum in the metal phosphate containing aluminum is 1.0 mol % or more and 95.0 mol % or less with respect to all metal elements of the metal phosphate containing aluminum, and the metal phosphate containing aluminum is obtained by adding an aluminum compound to the aqueous medium and/or the suspension.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
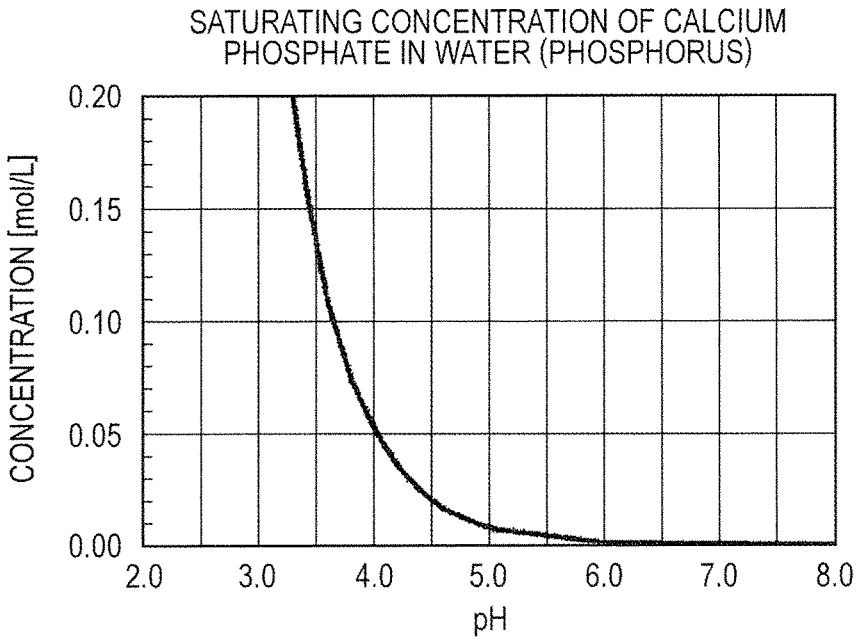
FIG. 1 is a solubility curve of a calcium phosphate compound with respect to a pH.

Many of the metal phosphates dissolve in water when a pH is reduced. The solubility curve of a calcium phosphate compound serving as a typical metal phosphate with respect to a pH is shown in FIG. 1.

In addition, when a metal phosphate is dispersed in water, a pH may change with temperature.

Accordingly, in the case where a toner is produced by a suspension polymerization method through the use of a metal phosphate as a dispersion stabilizer, a pH may be changed by a temperature change in a production process. At that time, there is a risk in that the metal phosphate dissolves. In addition, the same holds true for the case where the pH is intentionally reduced in the production process. As a result, toner particles may coalesce during the production process.

Figure 2:
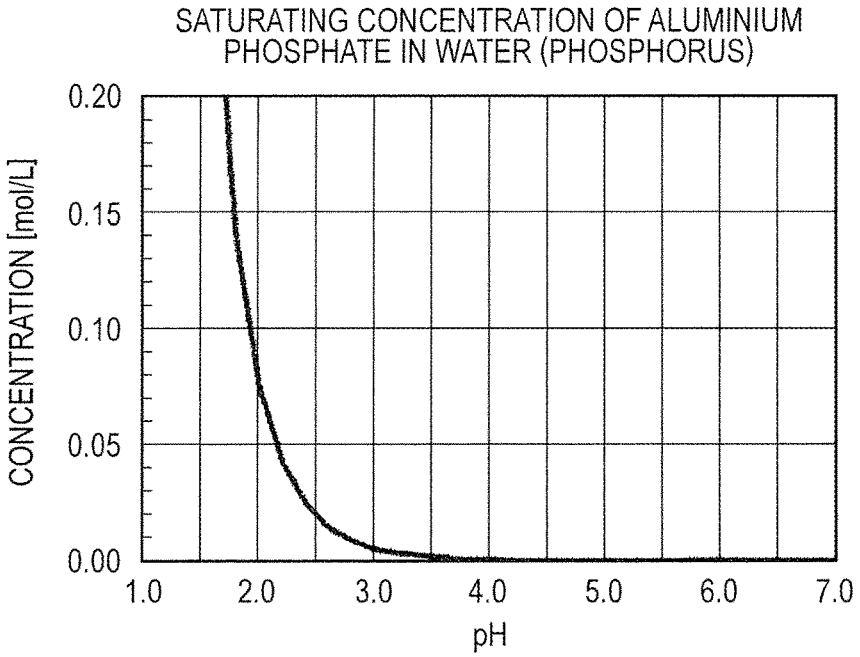
FIG. 2 is a solubility curve of aluminum phosphate with respect to a pH.

Meanwhile, the solubility curve of aluminum phosphate with respect to a pH is shown in FIG. 2. Of the metal phosphates, aluminum phosphate has particularly low solubility at a low pH. Accordingly, when suspension polymerization is performed by using aluminum phosphate as a dispersion stabilizer, the coalescence of toner particles in a production process hardly occurs. However, it is difficult to wash off aluminum phosphate with an acid owing to its low solubility at a low pH, and hence the dispersion stabilizer is liable to remain in the toner.

The inventors of the present invention have made extensive investigations for simultaneously achieving those incompatible characteristics, and as a result, have reached a method of producing a toner described in the present invention.

The method of producing a toner of the present invention is a method of producing a toner including toner particle. The production method includes: a granulation step of mixing a polymerizable monomer composition containing a polymerizable monomer and an aqueous medium to form a suspension of particle of the polymerizable monomer composition; and a polymerization step of polymerizing the polymerizable monomer in the particle of the polymerizable monomer composition in the presence of a metal phosphate containing aluminum as a metal element to provide the toner particle. The content ratio of aluminum in the metal phosphate containing aluminum is 1.0 mol % or more and 95.0 mol % or less with respect to all metal elements of the metal phosphate containing aluminum. In addition, the metal phosphate containing aluminum is obtained by adding an aluminum compound to the aqueous medium and/or the suspension.

When the aluminum ratio of the metal elements falls within the range and the metal phosphate containing aluminum is obtained by adding the aluminum compound to an aqueous phase, a dispersion stabilizer that hardly dissolves at a low pH and can be easily removed at the time of washing can be obtained.

In addition, in the present invention, the polymerizable monomer composition and a droplet of the polymerizable monomer composition in the suspension are each also referred to as "oil phase." In addition, the aqueous medium and the continuous phase of the aqueous medium in the suspension are each also referred to as "aqueous phase."

The reasons why those characteristics can be simultaneously achieved are assumed to be as follows: partial incorporation of the aluminum element having a high bonding force with phosphoric acid can provide a metal phosphate that hardly dissolves even at a low pH; and the metal phosphate can be easily removed merely by dissolving, at the time of the washing, phosphoric acid and the aluminum portion that are partially present.

When the aluminum compound is added to the oil phase, it becomes difficult to remove the dispersion stabilizer because the aluminum compound remains in the toner particle. In addition, in order that the metal phosphate containing aluminum as a metal element may act as the dispersion stabilizer, the metal phosphate needs to be insolubilized in the aqueous phase and present as fine particles. Accordingly, no effect is obtained in a state in which aluminum is solubilized in the aqueous phase.

In addition, when the metal phosphate containing aluminum as a metal element is produced, the following method is more preferred: first, a metal phosphate containing a metal element except aluminum is prepared, and then the aluminum compound is added to an aqueous phase containing the metal phosphate containing a metal element except aluminum. The performance of the production method described in the foregoing substitutes a metal element on the surface of the metal phosphate containing a metal element except aluminum with aluminum. This is probably because the aluminum element is less likely to be stably present in an aqueous system than any other metal element is, and is hence liable to be bonded to a phosphate ion or a hydroxide ion.

As a result, a dispersion stabilizer clearly having a structure in which a large amount of aluminum is present near the surface of the metal phosphate containing aluminum, and any other metal element is present in the inside is obtained. Accordingly, more excellent characteristics can be simultaneously achieved.

The metal phosphate containing aluminum, which is preferably a composite of aluminum and a phosphate of any other metal element, may be a mixture of hardly water-soluble inorganic aluminum and a metal phosphate.

The content ratio of aluminum in the metal phosphate containing aluminum needs to be 1.0 mol % or more and 95.0 mol % or less with respect to all the metal elements of the metal phosphate containing aluminum, and is more preferably 1.0 mol % or more and 50.0 mol % or less. When the content ratio is 50.0 mol % or less, the dispersion stabilizer can be sufficiently washed off, and hence a toner further reduced in remaining amount of the dispersion stabilizer can be obtained.

Although the ratio of aluminum can be controlled based on the loading ratios of raw materials, temperature, or a pH at the time of the preparation of the metal phosphate containing aluminum, it is simple and preferred to control the ratio based on the loading ratios of the raw materials out of the parameters.

The metal phosphate containing aluminum is more preferably a metal phosphate containing aluminum and calcium as metal elements. The incorporation of aluminum and calcium as the metal elements can provide a dispersion stabilizer that hardly dissolves even in a pH region of from 4 or more to 7 or less, and has high stability. Thus, the granulation step can be performed in the pH region, and hence minute particles due to an excessive reduction in interfacial tension are hardly produced, and toner particles having a sharp particle size distribution can be obtained. Accordingly, a toner yield and the developing characteristic of the toner become more excellent.

In addition, a content ratio between calcium and aluminum in the metal phosphate containing aluminum and calcium is preferably 50.0/50.0 or more and 99.0/1.0 or less in terms of a molar ratio. When the ratio is 50.0/50.0 or more, a dispersion stabilizer that can be sufficiently removed in a washing step is obtained, and hence the dispersion stabilizer hardly remains in the toner. When the ratio is 99.0/1.0 or less, a dispersion stabilizer that hardly dissolves even at a low pH is obtained, and hence the toner can be suppressed from becoming a coarse particle. It is simple and preferred to control the content ratio between calcium and aluminum based on the loading ratios of the raw materials at the time of the preparation of the metal phosphate containing aluminum.

A method of measuring the ratio of a metal element in the metal phosphate containing aluminum is described later.

The metal phosphate containing aluminum is more preferably obtained by adding a calcium compound and a phosphoric acid compound to the aqueous medium, and then adding the aluminum compound. The performance of the production method described in the foregoing leads to the provision of a dispersion stabilizer having a structure in which a large amount of aluminum is present near the surface of the metal phosphate containing aluminum, and calcium is present in the inside. As a result, more excellent characteristics can be simultaneously achieved from the viewpoints of: the formation of a coarse particle; the dispersion stabilizer remaining in the toner; and the particle size distribution of the toner.

In the metal phosphate containing aluminum, examples of the metal element except aluminum include magnesium, calcium, strontium, barium, iron, zirconium, gallium, indium, thallium, germanium, tin, lead, bismuth, vanadium, niobium, tantalum, chromium, molybdenum, tungsten, manganese, ruthenium, cobalt, nickel, copper, zinc, and silver. Of those, as described above, calcium is preferred.

Examples of the aluminum compound for introducing an aluminum element into the metal phosphate containing a metal element except aluminum include: inorganic and organic aluminum compounds, such as aluminum phosphate, aluminum hydroxide, aluminum oxide, aluminum chloride, aluminum sulfate, aluminum nitrate, and aluminum lactate; and aluminum alkoxides, such as aluminum-sec-butoxide and aluminum isopropoxide.

A hardly water-soluble aluminum compound may be added, or the following procedure may be adopted: a water-soluble aluminum compound is added and insolubilized in the aqueous phase.

Further, a surfactant may be added to the aqueous medium and/or the suspension. Specifically, a commercial nonionic, anionic, or cationic surfactant may be utilized. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

A monomer that may be used as the polymerizable monomer is, for example, a styrene-based monomer, an acrylic monomer, or a methacrylic monomer.

Examples of the styrene-based monomer include styrene and styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene.

Examples of the acrylic monomer include methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, stearyl acrylate, behenyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate.

Examples of the methacrylic monomer include methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, stearyl methacrylate, behenyl methacrylate, diethyl phosphate ethyl methacrylate, and dibutyl phosphate ethyl methacrylate.

Further, a monomer having a plurality of polymerizable functional groups (also referred to as "polyfunctional monomer") may be added.

Examples of the polyfunctional monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

In the method of producing a toner of the present invention, a wax may be further incorporated into the polymerizable monomer composition for reducing the fixation temperature of the toner and suppressing a phenomenon in which the toner sticks to a fixing member at the time of high-temperature fixation (hot offset). Examples thereof include: an ester of a monohydric alcohol and an aliphatic carboxylic acid, or an ester of a monovalent carboxylic acid and an aliphatic alcohol, e.g., behenyl behenate, stearyl stearate, or palmityl palmitate; an ester of a dihydric alcohol and an aliphatic carboxylic acid, or an ester of a divalent carboxylic acid and an aliphatic alcohol, e.g., dibehenyl sebacate or hexanediol dibehenate; an ester of a trihydric alcohol and an aliphatic carboxylic acid, or an ester of a trivalent carboxylic acid and an aliphatic alcohol, e.g., glycerin tribehenate; an ester of a tetrahydric alcohol and an aliphatic carboxylic acid, or an ester of a tetravalent carboxylic acid and an aliphatic alcohol, e.g., pentaerythritol tetrastearate or pentaerythritol tetrapalmitate; an ester of a hexahydric alcohol and an aliphatic carboxylic acid, or an ester of a hexavalent carboxylic acid and an aliphatic alcohol, e.g., dipentaerythritol hexastearate or dipentaerythritol hexapalmitate; an ester of a polyhydric alcohol and an aliphatic carboxylic acid, or an ester of a polyvalent carboxylic acid and an aliphatic alcohol, e.g., polyglycerin behenate; a natural ester wax, e.g., a carnauba wax or a rice bran wax; a petroleum-based wax or a derivative thereof, e.g., a paraffin wax, a microcrystalline wax, or petrolatum; a hydrocarbon wax or a derivative thereof produced by a Fischer-Tropsch method; a polyolefin wax or a derivative thereof, e.g., a polyethylene wax or a polypropylene wax; a higher aliphatic alcohol; a fatty acid, e.g., stearic acid or palmitic acid; and an acid amide wax.

The content of the wax is preferably 1.0 part by mass or more and 20.0 parts by mass or less with respect to 100 parts by mass of a binder resin.

In addition, in the method of producing a toner of the present invention, a crystalline resin may be further incorporated into the polymerizable monomer composition for reducing the fixation temperature of the toner. Examples of the crystalline resin include a crystalline polyester and a crystalline acrylic resin.

When the wax or the crystalline resin is added to the polymerizable monomer composition, the formation of a coarse particle in a toner production process is liable to occur because the viscosity of the polymerizable monomer composition reduces. Accordingly, the method of producing a toner in the present invention is particularly effective.

The content of the crystalline resin is preferably 1.0 part by mass or more and 50.0 parts by mass or less with respect to 100 parts by mass of a binder resin.

In the method of producing a toner of the present invention, a polar resin may be further incorporated into the polymerizable monomer composition. The polar resin refers to a resin having a functional group having a low acid dissociation constant, such as a carboxy group or a sulfone group, or a resin having a functional group having a low base dissociation constant, such as an amino group. The kind of the resin is, for example, a known resin that has heretofore been used in a toner, and examples thereof include a polyester-based resin and a vinyl-based resin.

The content of the polar resin is preferably 1.0 part by mass or more and 30.0 parts by mass or less with respect to 100 parts by mass of a binder resin.

In addition, in the method of producing a toner of the present invention, a charge control agent may be further used in the polymerizable monomer composition.

Examples of a charge control agent that controls the toner particles so that the particles may be negatively chargeable include the following charge control agents.

There are given an organic metal compound, a chelate compound, a monoazo metal compound, an acetylacetone metal compound, a urea derivative, a metal-containing salicylic acid-based compound, a metal-containing naphthoic acid-based compound, a quaternary ammonium salt, Calixarene, a silicon compound, a non-metal carboxylic acid-based compound, and derivatives thereof. In addition, a sulfonic acid resin having a sulfonic acid group, a sulfonic acid salt group, or a sulfonic acid ester group may be preferably used.

For example, the following charge control agents may be used as a charge control agent that controls the toner particles so that the particles may be positively chargeable.

Examples thereof include nigrosin and modified products thereof with fatty acid metal salts, quaternary ammonium salts, such as tributylbenzylammonium-1-hydroxy-4-naphthosulfonate and tetrabutylammonium tetrafluoroborate, and onium salts such as phosphonium salts serving as analogs thereof, and lake pigments thereof, triphenylmethane dyes and lake pigments thereof (as laking agents, there are given, for example, phosphotungstic acid, phosphomolybdic acid, phosphotungstomolybdic acid, tannic acid, lauric acid, gallic acid, a ferricyanide, and a ferrocyanide), and metal salts of higher fatty acids. One kind of the charge control agents may be used alone, or two or more kinds thereof may be used in combination.

The content of the charge control agent is preferably 0.01 part by mass or more and 5.00 parts by mass or less with respect to 100 parts by mass of a binder resin.

The addition of the polar resin or the charge control agent to the polymerizable monomer composition reduces an interfacial tension between the polymerizable monomer composition and water, and hence provides toner particles having smaller particle diameters and a uniform particle size distribution.

In the method of producing a toner of the present invention, a colorant may be further incorporated into the polymerizable monomer composition. Examples of the colorant include a black colorant, a yellow colorant, a magenta colorant, and a cyan colorant.

A specific example of the black colorant is carbon black.

Specific examples of the yellow colorant include the following yellow pigments typified by: a monoazo compound; a disazo compound; a condensed azo compound; an isoindolinone compound; an isoindoline compound; a benzimidazolone compound; an anthraquinone compound; an azo metal complex; a methine compound; and an arylamide compound. A more specific example thereof is the following: C.I. Pigment Yellow 74, 93, 95, 109, 111, 128, 155, 174, 180, or 185.

Specific examples of the magenta colorant include the following magenta pigments typified by: a monoazo compound; a condensed azo compound; a diketopyrrolopyrrole compound; an anthraquinone compound; a quinacridone compound; a basic dye lake compound; a naphthol compound; a benzimidazolone compound; a thioindigo compound; and a perylene compound. More specific examples thereof include the following: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269; and C.I. Pigment Violet 19.

Specific examples of the cyan colorant include the following cyan pigments typified by: a copper phthalocyanine compound and a derivative thereof; an anthraquinone compound; and a basic dye lake compound. A more specific example thereof is the following: C.I. Pigment Blue 1, 7, 15, 15:1, 15:2, 15:3, 15:4, 60, 62, or 66.

In addition, various dyes that have heretofore been known as colorants may be used together with the foregoing pigments.

The content of the colorant is preferably 1.0 part by mass or more and 20.0 parts by mass or less with respect to 100 parts by mass of a binder resin.

The present invention is further described below by taking a production method involving using a suspension polymerization method as an example, but is not limited to the following.

A polymerizable monomer composition is prepared by: adding a known release agent or charge control agent, a solvent for viscosity adjustment, a crystalline resin, a plasticizer, a chain transfer agent, and any other additive to a polymerizable monomer as required; and dissolving or dispersing the materials with a dispersing machine, such as a homogenizer, a ball mill, a colloid mill, or an ultrasonic dispersing machine.

Next, granulation is performed by: loading the polymerizable monomer composition into an aqueous medium prepared in advance, the aqueous medium containing a metal phosphate as a dispersion stabilizer; and suspending the composition with a high-speed stirring machine or a high-speed dispersing machine, such as an ultrasonic dispersing machine.

At this time, a metal phosphate containing aluminum as a metal element may be prepared by adding an aluminum compound to the aqueous medium containing a metal phosphate containing a metal element except aluminum before the performance of the granulation. In addition, the metal phosphate containing aluminum as a metal element may be prepared by adding the aluminum compound to the suspension containing the metal phosphate containing a metal element except aluminum at any timing after the performance of the granulation.

A polymerization initiator may be used at the time of the polymerization of the polymerizable monomer in each of the particles of the polymerizable monomer composition. The polymerization initiator may be mixed together with any other additive at the time of the preparation of the polymerizable monomer composition, or may be mixed in the polymerizable monomer composition immediately before the suspension in the aqueous medium. In addition, the initiator may be added in a state of being dissolved in the polymerizable monomer or any other solvent as required during the granulation or after the completion of the granulation, i.e., immediately before the initiation of a polymerization reaction.

The suspension after the granulation is heated, and the polymerization reaction is performed while the suspension is stirred so that the particles of the polymerizable monomer composition in the suspension may maintain their particle states, and the floating or sedimentation of the particles may not occur. After the reaction has been completed, a desolvation treatment is performed as required. Thus, an aqueous dispersion of toner particles is formed.

In addition, the temperature of the suspension may be increased in the latter half of the polymerization reaction for the purpose of obtaining a desired molecular weight distribution. Further, part of the aqueous medium may be distilled off by a distillation operation in the latter half of the reaction or after the completion of the reaction in order that an unreacted polymerizable monomer, a by-product, the solvent, and the like may be removed to the outside of the system. The distillation operation may be performed under normal pressure or reduced pressure.

After that, the resultant is washed, and is dried and classified by various methods. Thus, the toner particles can be obtained. Further, a toner can be obtained by externally adding the inorganic fine powder or the like to the toner particles.

The toner of the present invention may be used as it is as a one-component developer, or may be used as a two-component developer after having been mixed with a magnetic carrier.

The production method of the present invention more preferably includes: a step of adding a calcium compound and a phosphoric acid compound to the aqueous medium, followed by the addition of the aluminum compound to prepare the metal phosphate containing aluminum as a metal element; the granulation step of mixing the polymerizable monomer composition containing the polymerizable monomer and the aqueous medium to form the suspension of the particle of the polymerizable monomer composition; and the polymerization step of polymerizing the polymerizable monomer in the particle of the polymerizable monomer composition in the presence of the metal phosphate containing aluminum to provide the toner particle.

In addition, the production method also suitably includes: a step of adding a calcium compound and a phosphoric acid compound to the aqueous medium to prepare a calcium phosphate compound; the granulation step of mixing the polymerizable monomer composition containing the polymerizable monomer and the aqueous medium to form the suspension; a step of adding the aluminum compound to the suspension to prepare the metal phosphate containing aluminum as a metal element; and the polymerization step of polymerizing the polymerizable monomer in the particle of the polymerizable monomer composition in the presence of the metal phosphate containing aluminum to provide the toner particle.

The pH change of the aqueous medium and/or the suspension in a time period from the granulation step to the polymerization step is preferably 0.3 or more and 6.0 or less. When the pH change falls within the range of from 0.3 or more to 6.0 or less, the effects of the present invention are effectively exhibited. In addition, when the pH change is 6.0 or less, toner particles having a sharper particle size distribution can be produced in the polymerization step.

According to the present invention, there can be provided a method of producing a toner in which the coalescence of toner particles in a production process is suppressed and a dispersion stabilizer can be easily removed in a washing step.

Methods of measuring respective physical property values specified in the present invention are described below.

<Measurement of Molar Ratio of Metal Element in Metal Phosphate, and Measurement of Amount of Metal Phosphate Remaining in Toner Particle>

The analysis of the molar ratio of a metal element in a metal phosphate and the amount of the metal phosphate remaining in toner particles is performed with fluorescent X-rays. The measurement of the amount of each element with the fluorescent X-rays, which is in conformity with JIS K 0119-1969, is specifically as described below.

A wavelength dispersive fluorescent X-ray analyzer "Axios" (manufactured by PANalytical), and dedicated software "Super-Q ver. 4.0F" (manufactured by PANalytical) included in the apparatus for setting measurement conditions and analyzing measurement data are used as a measuring apparatus. Rh is used as the anode of an X-ray tube, and the measurement is performed in a vacuum atmosphere at a measurement diameter (collimator mask diameter) of 27 mm for a measurement time of 10 seconds. In addition, when the amount of a light element is measured, an X-ray is detected with a proportional counter (PC), and when the amount of a heavy element is measured, an X-ray is detected with a scintillation counter (SC).

A pellet obtained as described below is used as a measurement sample. A sample of 4 g is loaded into a dedicated aluminum ring for pressing and flattened, and is then pressed with a tablet-molding compressing machine "BRE-32" (manufactured by Maekawa Testing Machine MFG. Co., Ltd.) at 20 MPa for 60 seconds to be molded into a pellet having a thickness of 2 mm and a diameter of 39 mm.

The measurement is performed under the foregoing conditions. An element is identified based on the resultant X-ray peak position, and its concentration is calculated from a counting rate (unit: cps) serving as the number of X-ray photons per unit time.

In the measurement, the weight ratios of all the elements in the sample were measured by using a FP determination method and converted into mol % units.

In addition, in the measurement of the molar ratio of a metal element of a metal phosphate in each example, a sample was separately prepared by: preparing only an aqueous phase without adding the polymerizable monomer composition in each example; and then centrifuging and drying the metal phosphate.

<Content of Particles Each Having Particle Diameter of 2.0 μm or Less in Toner Particles>

The content of particles each having a particle diameter of 2.0 μm or less in toner particles is measured with a flow type particle image analyzer "FPIA-3000" (manufactured by Sysmex Corporation) under measurement and analysis conditions at the time of a calibration operation.

A specific measurement method is as described below. First, 20 ml of ion-exchanged water from which an impure solid and the like have been removed in advance is loaded into a glass container. 0.2 ml of a diluted solution obtained by diluting "Contaminon N" (a 10 mass % aqueous solution of a neutral detergent for washing a precision measuring unit formed of a nonionic surfactant, an anionic surfactant, and an organic builder, and having a pH of 7, manufactured by Wako Pure Chemical Industries, Ltd.) with ion-exchanged water by 3 mass fold is added as a dispersant to the container. Further, 0.02 g of a measurement sample is added to the container, and the mixture is subjected to a dispersion treatment with an ultrasonic dispersing unit for 2 minutes to provide a dispersion liquid for measurement. At that time, the dispersion liquid is appropriately cooled so as to have a temperature of 10° C. or more and 40° C. or less. A desktop ultrasonic cleaning and dispersing unit having an oscillatory frequency of 50 kHz and an electrical output of 150 W (e.g., "VS-150" (manufactured by VELVO-CLEAR)) is used as the ultrasonic dispersing unit. A predetermined amount of ion-exchanged water is loaded into a water tank, and 2 ml of the Contaminon N is added to the water tank.

The flow type particle image analyzer mounted with "UPlanApro" (magnification: 10, numerical aperture: 0.40) serving as an objective lens was used in the measurement, and a particle sheath "PSE-900A" (manufactured by Sysmex Corporation) was used as a sheath liquid. The dispersion liquid prepared in accordance with the foregoing procedure is introduced into the flow type particle image analyzer, and 3,000 toner particles are subjected to measurement according to the total count mode of an HPF measurement mode. Then, the frequency percent of a number-average particle diameter is measured by: setting a binarization threshold at the time of particle analysis to 85%; and limiting particle diameters to be analyzed to ones each corresponding to a circle-equivalent diameter of 1.985 μm or more and less than 39.69 μm. A value obtained by subtracting the frequency percent from 100% is calculated as the content of the particles each having a particle diameter of 2.0 μm or less in the toner particles.

In the measurement, automatic focusing is performed with standard latex particles (obtained by diluting, for example, "RESEARCH AND TEST PARTICLES Latex Microsphere Suspensions 5200A" manufactured by Duke Scientific with ion-exchanged water) prior to the initiation of the measurement. After that, focusing is preferably performed every 2 hours from the initiation of the measurement.

In Examples of the present application, a flow type particle image analyzer that had been subjected to a calibration operation by Sysmex Corporation and had received a calibration certificate issued by Sysmex Corporation was used. The measurement was performed under measurement and analysis conditions identical to those at the time of the reception of the calibration certificate except that the particle diameters to be analyzed were limited to ones each corresponding to a circle-equivalent diameter of 1.985 μm or more and less than 39.69 μm.

<Method of Measuring Weight-Average Particle Diameter (D4) of Toner Particles>

The weight-average particle diameter (D4) of the toner particles is calculated as described below. A precision particle size distribution measuring apparatus based on a pore electrical resistance method with a 100-micrometer aperture tube "Coulter Counter Multisizer 3" (trade name (trademark), manufactured by Beckman Coulter, Inc.) is used as a measuring apparatus. Dedicated software included therewith "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1 mass %, for example, "ISOTON II" (manufactured by Beckman Coulter, Inc.) may be used in the measurement.

The dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) The electrolyte aqueous solution of 200 mL is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counter-clockwise direction. Then, dirt and bubbles in the aperture tube are removed by the "Flush Aperture" function of the dedicated software.

(2) The electrolyte aqueous solution of 30 mL is charged into a 100-milliliter flat-bottom beaker made of glass. A diluted solution of 0.3 mL obtained by diluting "Contaminon N" (a 10 mass % aqueous solution of a neutral detergent for washing a precision measuring unit formed of a nonionic surfactant, an anionic surfactant, and an organic builder, and having a pH of 7, manufactured by Wako Pure Chemical Industries, Ltd.) with ion-exchanged water by three fold in terms of a mass ratio is added as a dispersant to the electrolyte aqueous solution.

(3) An ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W is prepared. Ion-exchanged water of 3.3 L is charged into the water tank of the ultrasonic dispersing unit. The Contaminon N of 2 mL is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) The toner particles or the dispersion liquid of the toner particles is gradually added to and dispersed in the electrolyte aqueous solution in the beaker in the section (4) under a state in which the electrolyte aqueous solution is irradiated with the ultrasonic wave so that the amount of the toner particles may be 10 mg. Then, the ultrasonic dispersion treatment is continued for an additional 60 seconds. The temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the concentration of the toner particles to be measured is adjusted to 5%. Then, measurement is performed until the particle diameters of 50,000 particles are measured.

(7) The measurement data is analyzed with the dedicated software included with the apparatus, and the weight-average particle diameter (D4) is calculated. The "Average Diameter" on the "Analysis/Volume Statistics (Arithmetic Average)" screen of the dedicated software when the dedicated software is set to show a graph in a vol % unit is the weight-average particle diameter (D4).

<Method of Measuring Weight-Average Molecular Weight Mw>

A weight-average molecular weight Mw is measured by gel permeation chromatography (GPC) as described below.

First, a sample is dissolved in tetrahydrofuran (THF) at room temperature over 24 hours. Then, the resultant solution is filtered with a solvent-resistant membrane filter "MyShoriDisk" (manufactured by Tosoh Corporation) having a pore diameter of 0.2 μm to provide a sample solution. The sample solution is prepared so as to have a concentration of a THF-soluble component of 0.8 mass %. Measurement is performed with the sample solution under the following conditions.

Apparatus: HLC 8120 GPC (detector: RI) (manufactured by Tosoh Corporation)

Column: Septuplicate of Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Sample injection amount: 0.10 ml

In the calculation of the molecular weight of the sample, a molecular weight calibration curve prepared with standard polystyrene resins (for example, trade names "TSK standard polystyrenes F-850, F-450, F-288, F-128, F-80, F-40, F-20, F-10, F-4, F-2, F-1, A-5000, A-2500, A-1000, and A-500" manufactured by Tosoh Corporation) is used.

<Method of Measuring Glass Transition Temperature Tg (° C.)>

A glass transition temperature Tg (° C.) is measured with a differential scanning calorimeter "Q1000" (manufactured by TA Instruments) in conformity with ASTM D3418-82. Temperature correction for the detecting portion of the apparatus is performed with the melting points of indium and zinc, and heat quantity correction therefor is performed with the heat of fusion of indium. Specifically, 2 mg of a measurement sample is precisely weighed and loaded into an aluminum pan. An empty aluminum pan is used as a reference. The temperature of the sample is increased at a rate of 10° C./min in the measuring range of from 0° C. to 100° C. The temperature is held at 100° C. for 15 minutes, and is then cooled from 100° C. to 0° C. at a rate of temperature decrease of 10° C./min. The temperature is held at 0° C. for 10 minutes, and then the measurement is performed in the range of from 0° C. to 100° C. at a rate of temperature increase of 10° C./min. In addition, a point of intersection of a line passing the middle point of a baseline before and after the appearance of the specific heat change of a specific heat change curve in the second temperature increase process, and a differential thermal curve is defined as the Tg (° C.).

<Method of Measuring Acid Value of Resin>

The acid value of a resin is measured in conformity with JIS K 1557-1970. A specific measurement method is described below.

A pulverized product of the sample of 2 g is precisely weighed (W (g)). The sample is loaded into a 200-milliliter Erlenmeyer flask, and 100 ml of a mixed solution of toluene and ethanol (2:1) is added to dissolve the sample over 5 hours. At this time, the flask may be heated as required. A phenolphthalein solution is added as an indicator to the solution. The solution is titrated with a 0.1 mol/L alcoholic solution of KOH through the use of a burette. The amount of the KOH solution at this time is represented by S (ml). A blank test is performed and the amount of the KOH solution at this time is represented by B (ml).

The acid value is calculated from the following equation. The symbol "f" in the equation represents the factor of the KOH solution.

$$\text{Acid value (mgKOH/g)}=[(S-B)\times f\times 5.61]/W$$

<Method of Measuring Amine Value of Resin>

An amine value is the number of milligrams of potassium hydroxide equivalent to perchloric acid needed for neutralizing all amines in 1 g of a sample. The amine value of a resin is measured in conformity with JIS K 7237-1995. Specifically, the measurement was performed in accordance with the following procedure.

(1) Preparation of Reagent

A crystal violet solution is obtained by dissolving 0.1 g of crystal violet in 100 mL of acetic acid. Perchloric acid of 8.5 mL is slowly added to and mixed in a solution obtained by mixing 500 mL of acetic acid and 200 mL of acetic anhydride in advance. Acetic acid is added to the mixture so that the total amount may be 1 L. After that, the resultant is left to stand for 3 days to provide a solution of perchloric acid in acetic acid. The factor of the solution of perchloric acid in acetic acid is determined by the following procedure. First, 1 mg of potassium hydrogen phthalate is weighed and dissolved in 20 mL of acetic acid. After that, 90 mL of o-nitrotoluene is added to the solution, and several droplets of the crystal violet solution are added to the mixture. The factor is determined by titrating the mixture with the solution of perchloric acid in acetic acid.

(2) Operation (A) Main Test

The sample of 2.0 g is precisely weighed in a 200-milliliter beaker, and 100 mL of a mixed solution of o-nitrotoluene and acetic acid (9:2) is added to dissolve the sample over 3 hours. Next, several droplets of the crystal violet solution are added to the solution, and the solution is titrated with the solution of perchloric acid in acetic acid. The amount of the solution of perchloric acid in acetic acid in which the blue color of the indicator changes to a green color and the green color continues for about 30 seconds is defined as the end point of the titration.

(B) Blank Test

The same test as the foregoing operation is performed except that no sample is used (that is, only the mixed solution of o-nitrotoluene and acetic acid (9:2) is used).

(3) Calculation of Total Amine Value

An amine value AmV is calculated by substituting the obtained results into the following equation:

$$\text{AmV}=[(D-C)\times f\times 5.61]/S$$

where AmV represents the amine value (mgKOH/g), C represents the addition amount (mL) of the solution of perchloric acid in acetic acid in the blank test, D represents the addition amount (mL) of the solution of perchloric acid in acetic acid in the main test, f represents the factor of the solution of perchloric acid in acetic acid, and S represents the mass (g) of the sample.

<Method of Measuring Charge Quantity>

Figure 3:
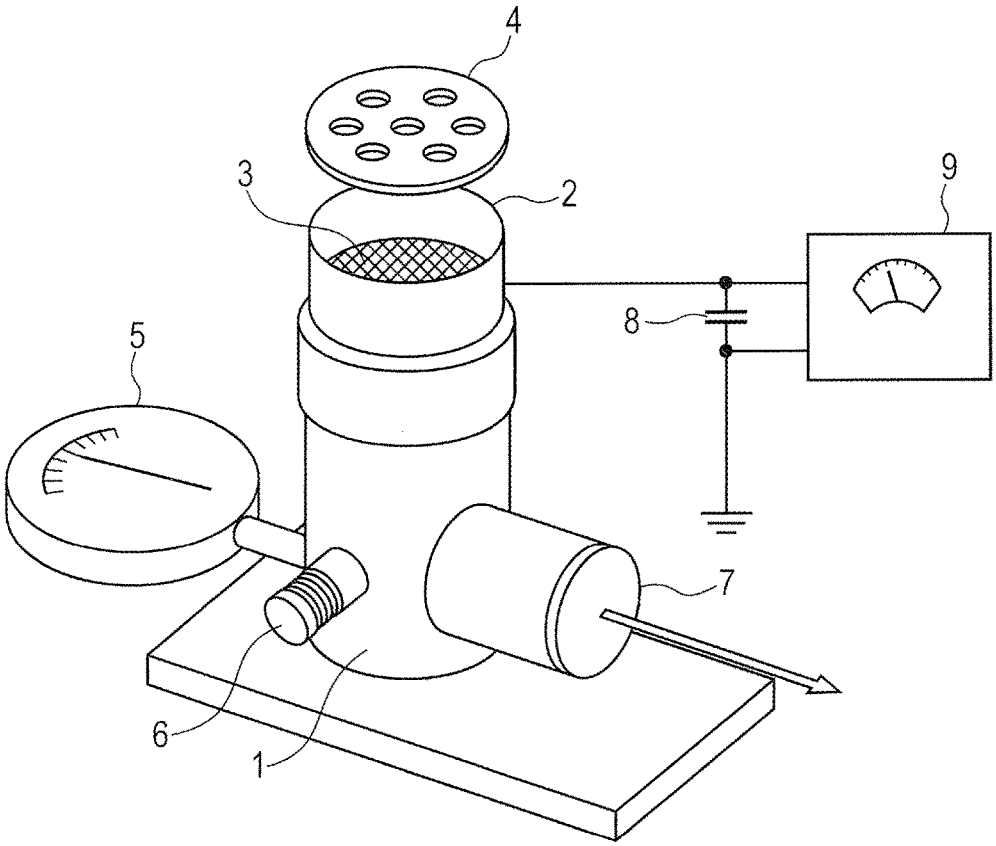
FIG. 3 is a schematic view of an apparatus used in charge quantity measurement of the present invention.

First, a two-component developer is prepared by adding a magnetic carrier to each of toner particles. In an apparatus illustrated in FIG. 3, 0.1 g of the two-component developer whose charge quantity is to be measured is loaded into a metallic measuring container 2 having a 635-mesh screen 3 at its bottom, and the container is lidded with a metallic lid. At this time, the mass of the entirety of the measuring container 2 is measured and represented by W1 (g). Next, in a sucking machine (at least a portion in contact with the measuring container 2 is an insulator), the developer is sucked from a suction port 7, and the pressure of a vacuum gauge 5 is set to 1.0 kPa by adjusting an air volume control valve 6. The two-component developer is sucked and removed by performing the suction in the state for 1 minute. The electric potential of a potentiometer 9 at this time is represented by V (volt(s)). Here, a capacitor 8 has a capacity of C (mF). The mass of the entirety of the measuring container after the suction is measured and represented by W2 (g). The charge quantity (mC/kg) of the two-component developer is calculated from the following equation.

$$\text{Charge quantity (mC/kg)}=(C\times V)/(W1-W2)$$

The present invention is specifically described below by way of Examples. However, the present invention is not limited to these Examples. All the terms "part(s)" used in Examples mean "part(s) by mass." Methods of producing toner particles 1 to 20 serve as Examples and methods of producing toner particles 21 to 24 serve as Comparative Examples.

<Production of Amorphous Resin 1>

100.0 Parts of a mixture obtained by mixing terephthalic acid, isophthalic acid, and an adduct of bisphenol A with 2 mol of propylene oxide at ratios of 25.0 mol %, 25.0 mol %, and 50.0 mol %, respectively was added to a reaction vessel including a stirring machine, a temperature gauge, a nitrogen-introducing tube, a dewatering tube, and a decompression apparatus, and was heated to a temperature of 130° C. while being stirred. After that, 0.52 part of tin di(2-ethylhexanoate) serving as an esterification catalyst was added to the mixture, and the temperature of the whole was increased to 200° C., followed by the performance of condensation polymerization until a desired molecular weight was obtained. Trimellitic anhydride of 3.0 Parts was further added to the resultant. Thus, an amorphous resin 1 was obtained. The weight-average molecular weight (Mw), glass transition temperature (Tg), and acid value of the amorphous resin 1 measured in accordance with the foregoing methods were 12,000, 70° C., and 8.2 mgKOH/g, respectively.

<Production of Amorphous Resin 2>

Xylene of 200 Parts was loaded into a reaction vessel including a stirring machine, a condenser, a temperature gauge, and a nitrogen-introducing tube, and was refluxed in a stream of nitrogen. As monomers, 85.0 Parts of styrene, 5.0 parts of n-butyl acrylate, 3.0 parts of methyl methacrylate, 3.0 parts of methacrylic acid, 3.0 parts of 2-hydroxyethyl methacrylate, and 5.0 parts of dimethyl 2,2'-azobis(2-methylpropionate) were mixed. The prepared mixture was dropped to the reaction vessel while xylene was stirred, and the whole was held at 65° C. for 10 hours. After that, the solvent was distilled off by performing distillation, and the residue was dried under reduced pressure at 40° C. to provide an amorphous resin 2. The weight-average molecular weight (Mw), glass transition temperature (Tg), and acid value of the amorphous resin 2 measured in accordance with the foregoing methods were 20,000, 75° C., and 19.2 mgKOH/g, respectively.

<Production of Amorphous Resin 3>

Xylene of 200 Parts was loaded into a reaction vessel including a stirring machine, a condenser, a temperature gauge, and a nitrogen-introducing tube, and was refluxed in a stream of nitrogen. As monomers, 88.0 Parts of styrene, 10.0 parts of n-butyl acrylate, 2.0 parts of diethylaminoethyl methacrylate, and 4.0 parts of azobisdimethylvaleronitrile were mixed. The prepared mixture was dropped to the reaction vessel while xylene was stirred, and the whole was held at 65° C. for 10 hours. After that, the solvent was distilled off by performing distillation, and the residue was dried under reduced pressure at 40° C. to provide an amorphous resin 3. The weight-average molecular weight (Mw), glass transition temperature (Tg), acid value, and amine value of the amorphous resin 3 measured in accordance with the foregoing methods were 18,000, 80° C., 0.0 mgKOH/g, and 4.2 mgKOH/g, respectively.

<Production of Toner Particles 1>

(Preparation of Polymerizable Monomer Composition)

| | |
|---|---|
| Styrene: | 180.0 parts |
| C.I. Pigment Blue 15:3: | 24.0 parts |

Those materials were loaded into an attritor (manufactured by Mitsui Miike Chemical Engineering Machinery Co., Ltd.). Further, the materials were dispersed by using zirconia particles each having a diameter of 1.7 mm at 220 rpm for 5 hours to provide a pigment dispersion liquid.

The following materials were added to the pigment dispersion liquid.

| | |
|---|---|
| Styrene: | 36.0 parts |
| n-Butyl acrylate: | 84.0 parts |
| Amorphous resin 1: | 15.0 parts |
| Paraffin wax (HNP-9: manufactured by Nippon Seiro Co., Ltd., melting point: 75° C.) | 21.0 parts |

The temperature of the materials was kept at 65° C., and the materials were uniformly dissolved and dispersed with T.K. Homomixer (manufactured by Tokushu Kika Kogyo Co., Ltd.) at 500 rpm. Thus, a polymerizable monomer composition was prepared.

(Preparation of Aqueous Medium)

A 0.05 mol/L aqueous solution of sodium phosphate of 1,500.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. A 1.0 mol/L aqueous solution of calcium chloride of 125.0 Parts was added to the solution. Thus, an aqueous medium containing a calcium phosphate compound was prepared. At this time, 10% hydrochloric acid was added in advance so that the pH of the aqueous medium containing the calcium phosphate compound became 5.0.

The temperature of 13.0 parts of a 1.0 mol/L aqueous solution of aluminum chloride was adjusted to 60° C. in advance. After the preparation of the aqueous medium, the solution was added, and the aqueous medium and aluminum chloride were mixed. Thus, a calcium phosphate compound containing aluminum was prepared as a dispersion stabilizer. The pH of the aqueous medium at this time was measured. As a result, the pH was 5.3 (pH at the time of a granulation step).

(Production of Suspension)

The polymerizable monomer composition was loaded into the aqueous medium, and 10.0 parts of t-butyl peroxypivalate serving as a polymerization initiator was added to the mixture. The resultant was granulated as it was with the stirring apparatus for 10 minutes while the number of revolutions was maintained at 15,000 revolutions/min. Thus, a suspension was obtained. After that, the stirring machine was changed from the high-speed stirring apparatus to a propeller stirring blade, and the suspension was subjected to a reaction at 70° C. for 5 hours while being refluxed. Further, the temperature of the suspension was increased to 85° C., and the suspension was subjected to a reaction for 2 hours. Here, part of the suspension was extracted and cooled, and the weight-average particle diameter of toner particles was measured by the method described in the foregoing. The weight-average particle diameter of the toner particles at this time is defined as a weight-average particle diameter D4

(μm) after the suspension has been heated to 85° C. and subjected to the reaction for 2 hours.

After that, the temperature of the suspension was increased to 98° C., and the suspension was subjected to a reaction for 5 hours. Thus, an unreacted polymerizable monomer was distilled off. The pH of the suspension at this time was measured. As a result, the pH was 4.2 (pH at the time of a polymerization step). The pH change of each of the aqueous medium and the suspension in a time period from the granulation step to the polymerization step was 1.1.

The suspension was cooled and hydrochloric acid was added to the cooled suspension to set its pH to 1.4, followed by stirring for 1 hour. Thus, the dispersion stabilizer was dissolved. After that, the suspension was washed with water whose amount was 10 times as large as that of the suspension, and was filtered and dried to provide toner particles 1. The weight-average molecular weight (Mw) and glass transition temperature (Tg) of the toner particles 1 measured in accordance with the foregoing methods were 45,000 and 45° C., respectively.

<Production of Toner Particles 2 to 7>

Toner particles 2 to 7 were obtained in the same manner as in the method of producing the toner particles 1 except that the addition numbers of parts of the 1.0 mol/L aqueous solution of calcium chloride and the 1.0 mol/L aqueous solution of aluminum chloride were changed as shown in Table 1. In the production of each of the toner particles 2 to 7, the addition amount of 10% hydrochloric acid was adjusted so that the pH at the time of the granulation step became 5.3. In addition, in the production of each of the toner particles 2 to 7, the pH at the time of the polymerization step was 4.2, and hence the pH change of each of the aqueous medium and the suspension in the time period from the granulation step to the polymerization step was 1.1.

TABLE 1

| | Addition number of parts of 1.0 mol/L aqueous solution of calcium chloride | Addition number of parts of 1.0 mol/L aqueous solution of aluminum chloride |
|---|---|---|
| Method of producing toner particles 1 | 125.0 | 13.0 |
| Method of producing toner particles 2 | 125.0 | 2.0 |
| Method of producing toner particles 3 | 125.0 | 7.0 |
| Method of producing toner particles 4 | 85.0 | 40.0 |
| Method of producing toner particles 5 | 65.0 | 60.0 |
| Method of producing toner particles 6 | 25.0 | 100.0 |
| Method of producing toner particles 7 | 10.0 | 120.0 |

<Production of Toner Particles 8>

(Preparation of Polymerizable Monomer Composition)

A polymerizable monomer composition was prepared in the same manner as in the preparation of the polymerizable monomer composition in the production of the toner particles 1.

(Preparation of Aqueous Medium)

A 0.05 mol/L aqueous solution of sodium phosphate of 1,500.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. A 1.0 mol/L aqueous solution of calcium chloride of 125.0 Parts was added to the solution. Thus, an aqueous medium containing a calcium phosphate compound was prepared. At this time, 10% hydrochloric acid was added in advance so that the pH of the aqueous medium containing the calcium phosphate compound became 5.0.

(Production of Suspension)

The polymerizable monomer composition was loaded into the aqueous medium, and 10.0 parts of t-butyl peroxypivalate serving as a polymerization initiator was added to the mixture. The resultant was granulated as it was with the stirring apparatus for 10 minutes while the number of revolutions was maintained at 15,000 revolutions/min. Thus, a suspension was obtained. After that, the stirring machine was changed from the high-speed stirring apparatus to a propeller stirring blade.

The temperature of 13.0 parts of a 1.0 mol/L aqueous solution of aluminum chloride was adjusted to 60° C. in advance. The solution was added to the suspension, and the suspension and aluminum chloride were mixed. Thus, a calcium phosphate compound containing aluminum was prepared as a dispersion stabilizer. The pH of the aqueous medium at this time was measured. As a result, the pH was 5.3 (pH at the time of a granulation step).

The suspension was subjected to a reaction at 70° C. for 5 hours while being refluxed. Further, the temperature of the suspension was increased to 85° C., and the suspension was subjected to a reaction for 2 hours. Here, part of the suspension was extracted and cooled, and the weight-average particle diameter of toner particles was measured by the method described in the foregoing.

After that, the temperature of the suspension was increased to 98° C., and the suspension was subjected to a reaction for 5 hours. Thus, an unreacted polymerizable monomer was distilled off. The pH of the suspension at this time was measured. As a result, the pH was 4.2 (pH at the time of a polymerization step). The pH change of each of the aqueous medium and the suspension in a time period from the granulation step to the polymerization step was 1.1.

The suspension was cooled and hydrochloric acid was added to the cooled suspension to set its pH to 1.4, followed by stirring for 1 hour. Thus, the dispersion stabilizer was dissolved. After that, the suspension was washed with water whose amount was 10 times as large as that of the suspension, and was filtered and dried to provide toner particles 8.

<Production of Toner Particles 9>

In the method of producing the toner particles 8, the timing at which the step of adding the 1.0 mol/L aqueous solution of aluminum chloride was performed was changed as follows: the step was performed after a lapse of 2 hours from the reaction of the suspension at 70° C. instead of a timing immediately after the production of the suspension. Toner particles 9 were obtained in the same manner as in the method of producing the toner particles 8 except the foregoing. The pH at the time of the granulation step was 5.0, the pH of the suspension after the addition of the aqueous solution of aluminum chloride was 5.3, and the pH at the time of the polymerization step was 4.2. The pH change of each of the aqueous medium and the suspension in the time period from the granulation step to the polymerization step was 1.1.

<Production of Toner Particles 10>

In the method of producing the toner particles 8, the timing at which the step of adding the 1.0 mol/L aqueous solution of aluminum chloride was performed was changed as follows: the step was performed after a lapse of 4.5 hours from the reaction of the suspension at 70° C. instead of a timing immediately after the production of the suspension. Toner particles 10 were obtained in the same manner as in the method of producing the toner particles 8 except the foregoing. The pH at the time of the granulation step was 5.0, the pH of the suspension after the addition of the aqueous solution of aluminum chloride was 5.3, and the pH at the time of the polymerization step was 4.2. The pH change of each of the aqueous medium and the suspension in the time period from the granulation step to the polymerization step was 1.1.

<Production of Toner Particles 11>

(Preparation of Polymerizable Monomer Composition)

A polymerizable monomer composition was prepared in the same manner as in the preparation of the polymerizable monomer composition in the production of the toner particles 1.

(Preparation of Aqueous Medium)

A 0.05 mol/L aqueous solution of 1,500.0 Parts of sodium phosphate was added to a container including a high-speed stirring apparatus CLEARMIX (manufactured by M Technique Co., Ltd.). The number of revolutions of the apparatus was adjusted to 15,000 rpm, and the solution was warmed to 60° C. A 1.0 mol/L aqueous solution of aluminum chloride of 13.0 Parts and 125.0 parts of a 1.0 mol/L aqueous solution of calcium chloride were added to the solution. Thus, a calcium phosphate compound containing aluminum was prepared as a dispersion stabilizer. At this time, 10% hydrochloric acid was added in advance so that the pH of the aqueous medium containing the calcium phosphate compound became 5.3 (pH at the time of a granulation step).

(Production of Suspension)

The polymerizable monomer composition was loaded into the aqueous medium, and 10.0 parts of t-butyl peroxypivalate serving as a polymerization initiator was added to the mixture. The resultant was granulated as it was with the stirring apparatus for 10 minutes while the number of revolutions was maintained at 15,000 revolutions/min. Thus, a suspension was obtained. After that, the stirring machine was changed from the high-speed stirring apparatus to a propeller stirring blade, and the suspension was subjected to a reaction at 70° C. for 5 hours while being refluxed. Further, the temperature of the suspension was increased to 85° C., and the suspension was subjected to a reaction for 2 hours. Here, part of the suspension was extracted and cooled, and the weight-average particle diameter of toner particles was measured by the method described in the foregoing.

After that, the temperature of the suspension was increased to 98° C., and the suspension was subjected to a reaction for 5 hours. Thus, an unreacted polymerizable monomer was distilled off. The pH of the suspension at this time was measured. As a result, the pH was 4.2 (pH at the time of a polymerization step). The pH change of each of the aqueous medium and the suspension in a time period from the granulation step to the polymerization step was 1.1.

The suspension was cooled and hydrochloric acid was added to the cooled suspension to set its pH to 1.4, followed by stirring for 1 hour. Thus, the dispersion stabilizer was dissolved. After that, the suspension was washed with water whose amount was 10 times as large as that of the suspension, and was filtered and dried to provide toner particles 11.

<Production of Toner Particles 12>

Toner particles 12 were obtained in the same manner as in the method of producing the toner particles 1 except that in the method of producing the toner particles 1, the 1.0 mol/L aqueous solution of aluminum chloride was changed to a 1.0 mol/L aqueous solution of aluminum hydroxide whose pH had been adjusted to 3.0 with hydrochloric acid. The addition amount of 10% hydrochloric acid was adjusted so that the pH at the time of the granulation step became 5.3. In addition, the pH at the time of the polymerization step was 4.2, and hence the pH change of each of the aqueous medium and the suspension in the time period from the granulation step to the polymerization step was 1.1.

<Production of Toner Particles 13>

Toner particles 13 were obtained in the same manner as in the method of producing the toner particles 1 except that in the method of producing the toner particles 1, the pH in the step of distilling off the unreacted polymerizable monomer by increasing the temperature of the suspension to 98° C. and subjecting the suspension to the reaction for 5 hours was changed from 4.2 to 3.9 (pH at the time of a polymerization step). The pH change of each of the aqueous medium and the suspension in the time period from the granulation step to the polymerization step was 1.4.

<Production of Toner Particles 14>

Toner particles 14 were obtained in the same manner as in the method of producing the toner particles 1 except that in the method of producing the toner particles 1, the amorphous resin 1 was changed to the amorphous resin 2, the pH of the aqueous medium containing the calcium phosphate compound as a dispersion stabilizer was changed from 5.0 to 9.0 (pH at the time of a granulation step), and the pH in the step of distilling off the unreacted polymerizable monomer by increasing the temperature of the suspension to 98° C. and subjecting the suspension to the reaction for 5 hours was changed from 4.2 to 7.0 (pH at the time of a polymerization step). The pH change of each of the aqueous medium and the suspension in the time period from the granulation step to the polymerization step was 2.0.

<Production of Toner Particles 15>

Toner particles 15 were obtained in the same manner as in the method of producing the toner particles 14 except that in the method of producing the toner particles 14, the pH in the step of distilling off the unreacted polymerizable monomer by increasing the temperature of the suspension to 98° C. and subjecting the suspension to the reaction for 5 hours was changed from 7.0 to 4.0 (pH at the time of a polymerization step). The pH change of each of the aqueous medium and the suspension in the time period from the granulation step to the polymerization step was 5.0.

<Production of Toner Particles 16>

(Preparation of Polymerizable Monomer Composition)

A polymerizable monomer composition was prepared in the same manner as in the preparation of the polymerizable monomer composition in the production of the toner particles 1 except that in the preparation of the polymerizable monomer composition in the production of the toner particles 1, the amorphous resin 1 was changed to the amorphous resin 2.

(Preparation of Aqueous Medium)

A 0.1 mol/L aqueous solution of sodium phosphate of 1,000.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. A 1.0 mol/L aqueous solution of magnesium chloride of 150.0 Parts was gradually added to the solution. Thus, an aqueous medium containing magnesium phosphate fine particles was prepared. At this time, 1 N sodium hydroxide was added so that the pH of the aqueous medium containing the magnesium phosphate fine particles became 9.0.

The temperature of 13.0 parts of a 1.0 mol/L aqueous solution of aluminum chloride was adjusted to 60° C. in advance. After the preparation of the aqueous medium, the solution was added and was mixed with the aqueous medium. Thus, magnesium phosphate containing aluminum was prepared as a dispersion stabilizer. At this time, the pH of the aqueous medium was appropriately adjusted so as to be 9.0 (pH at the time of a granulation step).

(Production of Suspension)

The polymerizable monomer composition was loaded into the aqueous medium, and 10.0 parts of t-butyl peroxypivalate serving as a polymerization initiator was added to the mixture. The resultant was granulated as it was with the stirring apparatus for 10 minutes while the number of revolutions was maintained at 15,000 revolutions/min. Thus, a suspension was obtained. After that, the stirring machine was changed from the high-speed stirring apparatus to a propeller stirring blade, and the suspension was subjected to a reaction at 70° C. for 5 hours while being refluxed. Further, the temperature of the suspension was increased to 85° C., and the suspension was subjected to a reaction for 2 hours. Here, part of the suspension was extracted and cooled, and the weight-average particle diameter of toner particles was measured by the method described in the foregoing.

After that, the temperature of the suspension was increased to 98° C., and the suspension was subjected to a reaction for 5 hours. Thus, an unreacted polymerizable monomer was distilled off. The pH of the suspension at this time was measured. As a result, the pH was 7.0 (pH at the time of a polymerization step). The pH change of each of the aqueous medium and the suspension in a time period from the granulation step to the polymerization step was 2.0.

The suspension was cooled and hydrochloric acid was added to the cooled suspension to set its pH to 1.4, followed by stirring for 1 hour. Thus, the dispersion stabilizer was dissolved. After that, the suspension was washed with water whose amount was 10 times as large as that of the suspension, and was filtered and dried to provide toner particles 16.

<Production of Toner Particles 17>

(Preparation of Polymerizable Monomer Composition)

A polymerizable monomer composition was prepared in the same manner as in the preparation of the polymerizable monomer composition in the production of the toner particles 1 except that in the preparation of the polymerizable monomer composition in the production of the toner particles 1, the amorphous resin 1 was changed to the amorphous resin 2.

(Preparation of Aqueous Medium)

A 0.5 mol/L aqueous solution of magnesium chloride of 1,000.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. A 2.0 mol/L aqueous solution of sodium hydroxide of 333.0 Parts was gradually added to the solution. Thus, an aqueous medium containing magnesium hydroxide fine particles was prepared. At this time, 1 N sodium hydroxide was further added so that the pH of the aqueous medium containing the magnesium hydroxide fine particles became 9.0.

The temperature of each of 50.0 parts of a 1.0 mol/L aqueous solution of aluminum chloride and 250.0 parts of a 2.0 mol/L aqueous solution of sodium phosphate was adjusted to 60° C. in advance. After the preparation of the aqueous medium, the solutions were added and were mixed with the aqueous medium. Thus, a metal phosphate containing aluminum and magnesium as metal elements was prepared as a dispersion stabilizer. At this time, the pH of the aqueous medium was appropriately adjusted so as to be 9.0 (pH at the time of a granulation step).

(Production of Suspension)

The polymerizable monomer composition was loaded into the aqueous medium, and 10.0 parts of t-butyl peroxypivalate serving as a polymerization initiator was added to the mixture. The resultant was granulated as it was with the stirring apparatus for 10 minutes while the number of revolutions was maintained at 15,000 revolutions/min. Thus, a suspension was obtained. After that, the stirring machine was changed from the high-speed stirring apparatus to a propeller stirring blade, and the suspension was subjected to a reaction at 70° C. for 5 hours while being refluxed. Further, the temperature of the suspension was increased to 85° C., and the suspension was subjected to a reaction for 2 hours. Here, part of the suspension was extracted and cooled, and the weight-average particle diameter of toner particles was measured by the method described in the foregoing.

After that, the temperature of the suspension was increased to 98° C., and the suspension was subjected to a reaction for 5 hours. Thus, an unreacted polymerizable monomer was distilled off. The pH of the suspension at this time was measured. As a result, the pH was 7.0 (pH at the time of a polymerization step). The pH change of each of the aqueous medium and the suspension in a time period from the granulation step to the polymerization step was 2.0.

The suspension was cooled and hydrochloric acid was added to the cooled suspension to set its pH to 1.4, followed by stirring for 1 hour. Thus, the dispersion stabilizer was dissolved. After that, the suspension was washed with water whose amount was 10 times as large as that of the suspension, and was filtered and dried to provide toner particles 17.

<Production of Toner Particles 18>

Toner particles 18 were obtained in the same manner as in the method of producing the toner particles 17 except that in the method of producing the toner particles 17, 15.0 parts of the amorphous resin 2 was changed to 4.0 parts of the amorphous resin 3. The pH at the time of the granulation step was appropriately adjusted so as to be 9.0. The pH at the time of the polymerization step was 7.0, and hence the pH change of each of the aqueous medium and the suspension in the time period from the granulation step to the polymerization step was 2.0.

<Production of Toner Particles 19>

In the method of producing the toner particles 18, the 0.5 mol/L aqueous solution of magnesium chloride was changed to a 0.3 mol/L aqueous solution of magnesium chloride, and the addition amount of the 1.0 mol/L aqueous solution of aluminum chloride was changed from 100.0 parts to 300.0 parts. Toner particles 19 were obtained in the same manner as in the method of producing the toner particles 18 except the foregoing. The pH at the time of the granulation step was appropriately adjusted so as to be 9.0. The pH at the time of the polymerization step was 7.0, and hence the pH change of each of the aqueous medium and the suspension in the time period from the granulation step to the polymerization step was 2.0.

<Production of Toner Particles 20>

Toner particles 20 were obtained in the same manner as in the method of producing the toner particles 19 except that in the method of producing the toner particles 19, the pH of the aqueous medium was changed from 9.0 to 7.0 (pH at the time of a granulation step). The pH in the step of distilling off the unreacted polymerizable monomer by increasing the temperature of the suspension to 98° C. and subjecting the suspension to the reaction for 5 hours was 6.2 (pH at the time of a polymerization step). The pH change of each of the aqueous medium and the suspension in the time period from the granulation step to the polymerization step was 0.8.

<Production of Toner Particles 21>

Toner particles 21 were obtained in the same manner as in the method of producing the toner particles 1 except that in the method of producing the toner particles 1, an aqueous medium containing calcium phosphate compound fine particles was prepared by performing the following change: the 1.0 mol/L aqueous solution of aluminum chloride was not added. The pH at the time of the granulation step was 5.0 and the pH at the time of the polymerization step was 4.2, and hence the pH change of each of the aqueous medium and the suspension in the time period from the granulation step to the polymerization step was 0.8.

<Production of Toner Particles 22>

Toner particles 22 were obtained in the same manner as in the method of producing the toner particles 1 except that in the method of producing the toner particles 1, the step of preparing the aqueous medium was changed as described below.

(Preparation of Aqueous Medium)

A 0.15 mol/L aqueous solution of sodium phosphate of 1,000.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. A 0.5 mol/L aqueous solution of aluminum chloride of 300.0 Parts was gradually added to the solution. Thus, an aqueous medium containing aluminum phosphate fine particles was prepared. At this time, 10% hydrochloric acid was added so that the pH of the aqueous medium containing the aluminum phosphate fine particles became 5.0. The pH at the time of the granulation step was 5.0 and the pH at the time of the polymerization step was 4.2, and hence the pH change of each of the aqueous medium and the suspension in the time period from the granulation step to the polymerization step was 0.8.

<Production of Toner Particles 23>

Toner particles 23 were obtained in the same manner as in the method of producing the toner particles 1 except that in the method of producing the toner particles 1, the step of preparing the aqueous medium was changed as described below.

(Preparation of Aqueous Medium)

A 0.5 mol/L aqueous solution of sodium hydroxide of 1,500.0 Parts was added to a container including a high-speed stirring apparatus CLEARMIX (manufactured by M Technique Co., Ltd.). The number of revolutions of the apparatus was adjusted to 15,000 rpm, and the solution was warmed to 60° C. 200.0 Parts of a 1.5 mol/L aqueous solution of aluminum chloride was gradually added to the solution. Thus, an aqueous medium containing aluminum phosphate fine particles was prepared. At this time, 10% hydrochloric acid was added so that the pH of the aqueous medium containing the aluminum phosphate fine particles became 5.0. The pH at the time of the granulation step was 5.0 and the pH at the time of the polymerization step was 4.2, and hence the pH change of each of the aqueous medium and the suspension in the time period from the granulation step to the polymerization step was 0.8.

<Production of Toner Particles 24>

Toner particles 24 were obtained in the same manner as in the method of producing the toner particles 18 except that in the method of producing the toner particles 18, the following change was performed: the 1.0 mol/L aqueous solution of aluminum chloride and the 2.0 mol/L aqueous solution of sodium phosphate were not added. The pH at the time of the granulation step was appropriately adjusted so as to be 9.0. The pH at the time of the polymerization step was 7.0, and hence the pH change of each of the aqueous medium and the suspension in the time period from the granulation step to the polymerization step was 2.0.

The physical properties of the toner particles obtained by the methods of producing the toner particles 1 to 20 serving as Examples 1 to 20, and the methods of producing the toner particles 21 to 24 serving as Comparative Examples 1 to 4 are collectively shown in Table 2.

TABLE 2

| | | Weight-average particle diameter D4 (μm) after suspension has been heated to 85° C. and subjected to reaction for 2 hours | Weight-average particle diameter D4 (μm) of toner particles | Aluminum content (mass %) of toner particles |
|---|---|---|---|---|
| Example 1 | Method of producing toner particles 1 | 6.4 | 6.4 | 0.002 |
| Example 2 | Method of producing toner particles 2 | 6.7 | 7.1 | 0.001 |
| Example 3 | Method of producing toner particles 3 | 6.5 | 6.5 | 0.002 |
| Example 4 | Method of producing toner particles 4 | 6.2 | 6.2 | 0.003 |
| Example 5 | Method of producing toner particles 5 | 6.2 | 6.2 | 0.005 |
| Example 6 | Method of producing toner particles 6 | 6.7 | 6.7 | 0.008 |
| Example 7 | Method of producing toner particles 7 | 6.7 | 6.7 | 0.009 |
| Example 8 | Method of producing toner particles 8 | 6.6 | 6.6 | 0.002 |
| Example 9 | Method of producing toner particles 9 | 6.6 | 6.6 | 0.002 |
| Example 10 | Method of producing toner particles 10 | 6.6 | 6.6 | 0.002 |
| Example 11 | Method of producing toner particles 11 | 6.6 | 7.3 | 0.002 |
| Example 12 | Method of producing toner particles 12 | 6.4 | 6.7 | 0.001 |
| Example 13 | Method of producing toner particles 13 | 6.4 | 6.4 | 0.002 |
| Example 14 | Method of producing toner particles 14 | 5.9 | 5.9 | 0.002 |
| Example 15 | Method of producing toner particles 15 | 5.9 | 6.3 | 0.002 |
| Example 16 | Method of producing toner particles 16 | 7.2 | 7.5 | 0.002 |

TABLE 2-continued

| | | Weight-average particle diameter D4 (μm) after suspension has been heated to 85° C. and subjected to reaction for 2 hours | Weight-average particle diameter D4 (μm) of toner particles | Aluminum content (mass %) of toner particles |
|---|---|---|---|---|
| Example 17 | Method of producing toner particles 17 | 7.2 | 7.5 | 0.002 |
| Example 18 | Method of producing toner particles 18 | 7.2 | 7.6 | 0.002 |
| Example 19 | Method of producing toner particles 19 | 6.8 | 7.1 | 0.005 |
| Example 20 | Method of producing toner particles 20 | 7.2 | 7.7 | 0.005 |
| Comparative Example 1 | Method of producing toner particles 21 | 6.6 | 8.1 | 0.000 |
| Comparative Example 2 | Method of producing toner particles 22 | 7.8 | 7.8 | 0.018 |
| Comparative Example 3 | Method of producing toner particles 23 | 7.6 | 8.4 | 0.010 |
| Comparative Example 4 | Method of producing toner particles 24 | 7.6 | 9.3 | 0.000 |

<Production of Dispersion Stabilizers 1 to 24>

In each of the methods of producing the toner particles 1 to 24, only the aqueous phase was prepared without the addition of the polymerizable monomer composition, and the resultant dispersion stabilizer was centrifuged, filtered, and dried. Thus, dispersion stabilizers 1 to 24 were obtained.

The metal element ratios of the resultant dispersion stabilizers 1 to 24 were measured by using the foregoing method. The results are collectively shown in Table 3.

TABLE 3

| | | Molar ratio (%) of metal element | | |
|---|---|---|---|---|
| | | Aluminum | Calcium | Magnesium |
| Example 1 | Dispersion stabilizer 1 | 10 | 90 | 0 |
| Example 2 | Dispersion stabilizer 2 | 1 | 99 | 0 |
| Example 3 | Dispersion stabilizer 3 | 6 | 94 | 0 |
| Example 4 | Dispersion stabilizer 4 | 31 | 69 | 0 |
| Example 5 | Dispersion stabilizer 5 | 48 | 52 | 0 |
| Example 6 | Dispersion stabilizer 6 | 80 | 20 | 0 |
| Example 7 | Dispersion stabilizer 7 | 93 | 7 | 0 |
| Example 8 | Dispersion stabilizer 8 | 10 | 90 | 0 |
| Example 9 | Dispersion stabilizer 9 | 10 | 90 | 0 |
| Example 10 | Dispersion stabilizer 10 | 10 | 90 | 0 |
| Example 11 | Dispersion stabilizer 11 | 10 | 90 | 0 |
| Example 12 | Dispersion stabilizer 12 | 13 | 87 | 0 |
| Example 13 | Dispersion stabilizer 13 | 10 | 90 | 0 |

TABLE 3-continued

| | | Molar ratio (%) of metal element | | |
|---|---|---|---|---|
| | | Aluminum | Calcium | Magnesium |
| Example 14 | Dispersion stabilizer 14 | 10 | 90 | 0 |
| Example 15 | Dispersion stabilizer 15 | 10 | 90 | 0 |
| Example 16 | Dispersion stabilizer 16 | 10 | 0 | 90 |
| Example 17 | Dispersion stabilizer 17 | 14 | 0 | 86 |
| Example 18 | Dispersion stabilizer 18 | 14 | 0 | 86 |
| Example 19 | Dispersion stabilizer 19 | 55 | 0 | 45 |
| Example 20 | Dispersion stabilizer 20 | 55 | 0 | 45 |
| Comparative Example 1 | Dispersion stabilizer 21 | 0 | 100 | 0 |
| Comparative Example 2 | Dispersion stabilizer 22 | 100 | 0 | 0 |
| Comparative Example 3 | Dispersion stabilizer 23 | 100 | 0 | 0 |
| Comparative Example 4 | Dispersion stabilizer 24 | 0 | 0 | 100 |

Performance evaluations were performed for each of the resultant toner particles in accordance with the following methods.

[Production Stability]

A difference between the weight-average particle diameter D4 (μm) after the suspension had been heated to 85° C. and subjected to the reaction for 2 hours, and the weight-average particle diameter D4 (μm) of the toner particles in a production process for the toner particles was evaluated in accordance with the following criteria. The difference means a change in particle diameter due to the coalescence of the toner particles in the step of distilling off the unreacted polymerizable monomer by increasing the temperature of the suspension to 98° C. and subjecting the suspension to the reaction for 5 hours, and the difference is preferably as small as possible because production stability becomes higher.

A: The change in particle diameter is less than 0.3 μm.

B: The change in particle diameter is 0.3 μm or more and less than 0.5 μm.

C: The change in particle diameter is 0.5 μm or more and less than 0.8 μm.

D: The change in particle diameter is 0.8 μm or more and less than 1.0 μm.

E: The change in particle diameter is 1.0 μm or more.

[Amount of Minute Particles]

The content (number %) of particles each having a particle diameter of 2.0 μm or less in the toner particles was evaluated in accordance with the following criteria.

(Evaluation Criteria)

A: The content of the particles each having a particle diameter of 2.0 μm or less in the toner particles is less than 10 number %.

B: The content of the particles each having a particle diameter of 2.0 μm or less in the toner particles is 10 number % or more and less than 20 number %.

C: The content of the particles each having a particle diameter of 2.0 μm or less in the toner particles is 20 number % or more and less than 30 number %.

D: The content of the particles each having a particle diameter of 2.0 μm or less in the toner particles is 30 number % or more and less than 40 number %.

E: The content of the particles each having a particle diameter of 2.0 μm or less in the toner particles is 40 number % or more.

[Environmental Stability of Chargeability]

A two-component developer was prepared as described below in order for the environmental stability of chargeability to be evaluated. a magnetic carrier F813-300 (manufactured by Powdertech Co., Ltd.) of 9.3 g and 0.7 g of toner particles to be evaluated were loaded into a 50-cubic centimeter lidded plastic bottle, and were shaken with a shaker (YS-LD: manufactured by Yayoi Co., Ltd.) at a speed of 4 reciprocations per second for 1 minute to provide a two-component developer of each of the toner particles.

The two-component developer was left to stand under a normal-temperature and normal-humidity environment (23° C./60%) for a whole day and night. After that, the developer was shaken 450 times over 3 minutes. Next, its triboelectric charge quantity was measured by the method described in the foregoing, and the resultant charge quantity was defined as a charge quantity N (mC/kg).

In addition, 10 g of a two-component developer similarly prepared was loaded into a 50-cubic centimeter plastic container, and was left to stand under a high-temperature and high-humidity environment (30° C./80%) for a whole day and night. After that, the developer was shaken 450 times over 3 minutes, and its charge quantity measured by the same method was defined as a charge quantity H (mC/kg).

A charge retention ratio (%) under the high-temperature environment was calculated from the charge quantity N and the charge quantity H thus obtained by using the following equation, and the environmental stability of the chargeability was evaluated in accordance with the following criteria.

$$\text{Charge retention ratio (\%)} = 100 \times \text{charge quantity } H \text{ (mC/kg)} / \text{charge quantity } N \text{ (mC/kg)}$$

(Evaluation Criteria)

A: The charge retention ratio (%) is 70% or more.

B: The charge retention ratio (%) is 60% or more and less than 70%.

C: The charge retention ratio (%) is 50% or more and less than 60%.

D: The charge retention ratio (%) is 40% or more and less than 50%.

E: The charge retention ratio (%) is less than 40%.

The results are shown in Table 4.

TABLE 4

| | | Production stability | | Amount of minute particles | | Environmental stability of chargeability | |
|---|---|---|---|---|---|---|---|
| | | Change in particle diameter (μm) | Rank | Content (number %) of particles each having particle diameter of 2.0 μm or less | Rank | Charge retention ratio (%) | Rank |
| Example 1 | Method of producing toner particles 1 | 0.0 | A | 7 | A | 72 | A |
| Example 2 | Method of producing toner particles 2 | 0.4 | B | 9 | A | 75 | A |
| Example 3 | Method of producing toner particles 3 | 0.2 | A | 7 | A | 71 | A |
| Example 4 | Method of producing toner particles 4 | 0.1 | A | 9 | A | 70 | A |
| Example 5 | Method of producing toner particles 5 | 0.1 | A | 9 | A | 63 | B |
| Example 6 | Method of producing toner particles 6 | 0.0 | A | 15 | B | 54 | C |
| Example 7 | Method of producing toner particles 7 | 0.2 | A | 16 | B | 52 | C |
| Example 8 | Method of producing toner particles 8 | 0.2 | A | 9 | A | 71 | A |
| Example 9 | Method of Producing toner | 0.2 | A | 7 | A | 72 | A |

TABLE 4-continued

| | | Production stability | | Amount of minute particles | | Environmental stability of chargeability | |
|---|---|---|---|---|---|---|---|
| | | Change in particle diameter (μm) | Rank | Content (number %) of particles each having particle diameter of 2.0 μm or less | Rank | Charge retention ratio (%) | Rank |
| | particles 9 | | | | | | |
| Example 10 | Method of producing toner particles 10 | 0.1 | A | 7 | A | 71 | A |
| Example 11 | Method of producing toner particles 11 | 0.7 | C | 15 | B | 70 | A |
| Example 12 | Method of producing toner particles 12 | 0.3 | B | 8 | A | 74 | A |
| Example 13 | Method of producing toner particles 13 | 0.4 | B | 9 | A | 73 | A |
| Example 14 | Method of producing toner particles 14 | 0.4 | B | 26 | C | 71 | A |
| Example 15 | Method of producing toner particles 15 | 0.4 | B | 23 | C | 70 | A |
| Example 16 | Method of producing toner particles 16 | 0.5 | C | 28 | C | 70 | A |
| Example 17 | Method of producing toner particles 17 | 0.5 | C | 28 | C | 71 | A |
| Example 18 | Method of producing toner particles 18 | 0.7 | C | 24 | C | 71 | A |
| Example 19 | Method of producing toner particles 19 | 0.3 | B | 22 | C | 66 | B |
| Example 20 | Method of producing toner particles 20 | 0.5 | C | 15 | B | 67 | B |
| Comparative Example 1 | Method of producing toner Particles 21 | 1.5 | E | 8 | A | 75 | A |

TABLE 4-continued

| | | Production stability | | Amount of minute particles | | Environmental stability of chargeability | |
|---|---|---|---|---|---|---|---|
| | | Change in particle diameter (μm) | Rank | Content (number %) of particles each having particle diameter of 2.0 μm or less | Rank | Charge retention ratio (%) | Rank |
| Comparative Example 2 | Method of producing toner particles 22 | 0.1 | A | 15 | B | 29 | E |
| Comparative Example 3 | Method of producing toner particles 23 | 0.8 | D | 19 | B | 51 | C |
| Comparative Example 4 | Method of producing toner particles 24 | 1.7 | E | 38 | D | 70 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002544, filed Jan. 8, 2016, which is hereby incorporated by reference herein in its entirety.

What is claimed is:

1. A method of producing a toner including a toner particle, the method comprising:

a granulation step of mixing a polymerizable monomer composition containing a polymerizable monomer and an aqueous medium to form a suspension of a particle of the polymerizable monomer composition; and a polymerization step of polymerizing the polymerizable monomer in the particle of the polymerizable monomer composition in a presence of a metal phosphate containing aluminum as a metal element to provide the toner particle, wherein, a content ratio of aluminum in the metal phosphate containing aluminum is 1.0 mol % or more and 95.0 mol % or less with respect to all metal elements of the metal phosphate containing aluminum, and the metal phosphate containing aluminum is obtained by adding an aluminum compound to the aqueous medium and/or the suspension.

2. A method of producing a toner according to claim 1, wherein the content ratio of aluminum in the metal phosphate containing aluminum is 1.0 mol % or more and 50.0 mol % or less with respect to all the metal elements.

3. A method of producing a toner according to claim 1, wherein the metal phosphate containing aluminum is a metal phosphate containing aluminum and calcium as metal elements.

4. A method of producing a toner according to claim 3, wherein a content ratio between calcium and aluminum in the metal phosphate containing aluminum and calcium is 50.0/50.0 or more and 99.0/1.0 or less in terms of a molar ratio.

5. A method of producing a toner according to claim 1, wherein the metal phosphate containing aluminum is obtained by adding a calcium compound and a phosphoric acid compound to the aqueous medium, and then adding the aluminum compound.

6. A method of producing a toner according to claim 1, wherein the production method comprises:

a step of adding a calcium compound and a phosphoric acid compound to the aqueous medium, followed by addition of the aluminum compound to prepare the metal phosphate containing aluminum as a metal element;

the granulation step of mixing the polymerizable monomer composition containing the polymerizable monomer and the aqueous medium to form the suspension of the particle of the polymerizable monomer composition; and the polymerization step of polymerizing the polymerizable monomer in the particle of the polymerizable monomer composition in the presence of the metal phosphate containing aluminum to provide the toner particle.

7. A method of producing a toner according to claim 1, wherein the production method comprises:

a step of adding a calcium compound and a phosphoric acid compound to the aqueous medium to prepare a calcium phosphate compound;

the granulation step of mixing the polymerizable monomer composition containing the polymerizable monomer and the aqueous medium to form the suspension of the particle of the polymerizable monomer composition;

a step of adding the aluminum compound to the suspension to prepare the metal phosphate containing aluminum as a metal element; and the polymerization step of polymerizing the polymerizable monomer in the particle of the polymerizable monomer composition in the presence of the metal phosphate containing aluminum to provide the toner particle.

8. A method of producing a toner according to claim 1, wherein a pH change of the aqueous medium and/or the suspension in a time period from the granulation step to the polymerization step is 0.3 or more and 6.0 or less.

* * * * *